US005701674A

United States Patent [19]

Mitchell

[11] Patent Number: 5,701,674

[45] Date of Patent: Dec. 30, 1997

[54] SHAVING CREAM DISPENSING RAZOR

[75] Inventor: John R. Mitchell, Darien, Ill.

[73] Assignee: Venture Innovations, Inc., Westmont, Ill.

[21] Appl. No.: 539,996

[22] Filed: Oct. 6, 1995

[51] Int. Cl.[6] ..... B26B 21/44

[52] U.S. Cl. ..... 30/41; 30/541

[58] Field of Search ..... 30/41, 86, 90, 30/535, 538, 541

[56] References Cited

U.S. PATENT DOCUMENTS

| | | | |
|---|---|---|---|
| 4,077,119 | 3/1978 | Selera | 30/41 |
| 4,377,034 | 3/1983 | Druash et al. . | |
| 4,908,945 | 3/1990 | Jacobson . | |
| 4,974,319 | 12/1990 | Maguire et al. | 30/41 |
| 5,016,351 | 5/1991 | Drahaus | 30/41 |
| 5,070,611 | 12/1991 | Derin et al. | 30/41 |
| 5,269,062 | 12/1993 | Dallaire et al. . | |

*Primary Examiner*—Douglas D. Watts

*Attorney, Agent, or Firm*—Trexler, Bushnell, Giangiorgi & Blackstone, Ltd.

[57] ABSTRACT

A razor body for use with a canister which contains aerosol shaving cream. The razor body may is also combined with the canister such that the razor body and canister form a razor system. The canister includes a body with a head formed on a distal head thereof and a neck formed between the head and the body. A shoulder is defined between the neck and the body. The razor body includes an elongated tubular body portion having walls which define an axially elongated cavity therein. A razor support is positioned on one end of the tubular body and a stabilizing structure is positioned on an end opposite the razor support. A plunger is positioned in the elongated cavity. A plunger includes a shaft with a plunger grip at one end of the shaft and a nozzle assembly positioned on the shaft opposite the plunger grip. The nozzle assembly includes a dispensing port which extends through an elongated slot in the wall of the razor body. The stabilizing structure of the tubular portion attaches to the canister for preventing axial and angular displacement of the razor body relative to the canister.

17 Claims, 3 Drawing Sheets

28
58
54
60
62
26
56
52
38
118
66
20
3
32
22
120
46
96
36
108
122
106
92
50
72
48
74
78
24
76

SHAVING CREAM DISPENSING RAZOR

BACKGROUND

The present invention relates to shaving devices which include a razor body attached to a canister for dispensing an aerosol type cream or foam.

Numerous devices have been created which combine razor bodies with shaving cream dispensing canisters for providing a convenient, small and disposable shaving systems. These devices employ a razor body which is attached to a canister and have some form of trigger mechanism which operates a valve on the canister to dispense shaving cream or foam from the canister. A razor head is attached to the razor body and may be a removable disposable type razor hear or a fixed permanent head. This group of devices which combines the razor body with the canister to provide a shaving handle are desirable because they are small, inexpensive and may be considered a disposable item. These items are desirable because they are compact and therefore suitable for travel, may be given away as promotional items and provide a convenient way of selling shaving foam and a razor thereby selling one product to two markets.

Even though there are numerous devices available, none of the devices has overcome all of the problems associated with combining a razor body with a shaving cream canister. More particularly, all of the previous devices are somewhat unstable, thereby making them difficult to use while shaving. When combining the razor body with a shaving cream canister to provide a razor handle, stability of the attachment of the razor body on the canister is very important. If the razor body is not securely retained on the canister, the body will tend to wobble thereby possibly causing nicks and cuts in the user'skin. The instability results from an inadequately designed attachment and stabilizing structure. The available razor devices tend to buckle or fold at the attachment section between the razor body and the canister as a result of the inadequate structural design of the attachment and stabilizing structure.

It should be noted also, that small canisters of shaving cream are available for convenience purposes such as use in hotels, hospitals, aircraft, etc. These small canisters are provided as a convenience for people who are willing to pay a premium for the convenience of the smaller size canisters. Disposable razors have been available for many years and are often preferred by travelers who may purchase razors during their travels and dispose of razors during their travel. However, the prior art has been unsuccessful in providing a combination razor body and canister which provides a secure and stable handle for shaving as well as a nozzle assembly which prevents clogging after dispensing foam.

More specifically, several patents are known which show a combination razor body and canister but have the problems set forth hereinabove or other problems. For example, U.S. Pat. No. 4,377,034 issued Mar. 22, 1983 to Druash et al. (hereinafter referred to as "Druash et al. '034") provides a razor body attached to a canister. The razor body in Druash et al. '034 attaches to the canister by engaging specialized radially extending projections which on an upper edge of the canister. Curved slots are provided on the razor body to engage the extending protrusions.

This configuration is not preferred since it requires a specialized canister structure. Shaving cream dispensing canisters are available which include a standard push button valve. Such canisters are sold as travel supplies for use with a razor. These canisters are not attached to razor assemblies. Therefore, it would be advantageous to use readily available canisters in the dispensing razor assembly. However, the device as shown in Druash et al. '034 requires specialized mounting projection to be provided on the canister. This requires a specialized canister for use with this type of device.

Further, the device in Druash et al. '034 is subject to material failure. The slots formed in the razor body for mounting the razor on the canister define small tab-like projection. These tab-like projection bear a substantial portion of the stress which may be applied when the razor body is moved relative to the canister. As such, these small tabs experience substantial forces which forces are exacerbated when force is applied at a position spaced away from the tabs. These tabs are subject to material failure thereby preventing use of the dispensing razor.

U.S. Pat. No. 5,016,351 issued May 21, 1991 to Drahus (hereinafter referred to as "Drahus '351") shows a razor body mounted to a canister. The device in Drahus '351 shows the instability problem as mentioned hereinabove. The body and canister assembly is intended to be used as a handle for shaving. If a user holds the canister and applies force to the razor head during shaving, the razor body will tend to shift on the top of the canister and possibly produce nicks and cuts in a similar manner as mentioned hereinabove. The instability results from the attachment structure of the razor body on the canister.

Projections or nipples used to attached the razor body to the canister are rounded and have a shape which promotes rocking or angular displacement of the body relative to an elongated axis of the assembly. Further, while shaving cream is usually dispensed from such a device by depressing a trigger or activator, the angular displacement of the body relative to the canister may activate the valve on the canister. Angular or side-to-side movement may produce angular activation of the valve thereby dispensing shaving cream accidentally. It should be clear that a traveler carrying such a device in their luggage may discover a foam-filled compartment if the razor is accidentally activated while the luggage is in transit, being loaded or unloaded.

Further, Drahus '351 has a problem in that the mouth of the nozzle is retained internally of the body. Any foam which may accumulate around the mouth of the nozzle may clog the trigger action relative to the body. If the foam dries, this may produce a detrimental blockage thereby preventing operation of the device.

Another example of an unstable razor device is shown in U.S. Pat. No. 5,269,062 issued Dec. 14, 1993 to Dallaire et al. (hereinafter referred to as Dallaire et al. '062) This device shows a razor body attached to a canister. The device in Dallaire et al. '062 does not show the body in cross section and as such the details of the structure which secures the razor to the canister cannot be understood. However, it can be seen that the razor body extends only partially over the top of the canister and as such, an annular groove is formed between the razor body and a shoulder of the canister. With reference to FIG. 7 in Dallaire et at. '062, the shoulder tapers inwardly towards a neck portion of the canister below a rim. The device in Dallaire et al. '062 does not securely engage the container body and as such is subject to the wobbling or flexing action described hereinabove.

OBJECTS AND SUMMARY

A general object satisfied by the claimed invention is to provide a razor device which includes a razor body for attachment to a canister and which razor body is securely retained once attached to a canister to prevent displacement of the body relative to the canister.

Another object satisfied by the claimed invention is to provide a razor body which includes a nozzle assembly which prevents clogging by shaving cream which may accumulate and dry on or near the nozzle of the assembly.

Still a further object satisfied by the claimed invention is to provide a razor system which includes a razor body attached to a aerosol canister and in which the razor body minimizes the number of parts, the material needed to form the razor body, and the assembly labor involved in assembling the razor body.

Briefly, and in accordance with the foregoing, the present invention envisions a razor body for use with a canister which contains aerosol shaving cream. The razor body is also combined with the canister such that the razor body and canister form a razor system. The canister includes a body with a head formed on a distal head thereof and a neck formed between the head and the body. A shoulder is defined between the neck and the body. The razor body includes an elongated tubular body portion having walls which define an axially elongated cavity therein. A razor support is positioned on one end of the tubular body and a stabilizing structure is positioned on an end opposite the razor support. A plunger is positioned in the elongated cavity. A plunger includes a shaft with a plunger grip at one end of the shaft and a nozzle assembly positioned on the shaft opposite the plunger grip. The nozzle assembly includes a dispensing port which extends through an elongated slot in the wall of the razor body. The stabilizing structure of the tubular portion attaches to the canister for preventing axial and angular displacement of the razor body relative to the canister.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figures 1, 2:
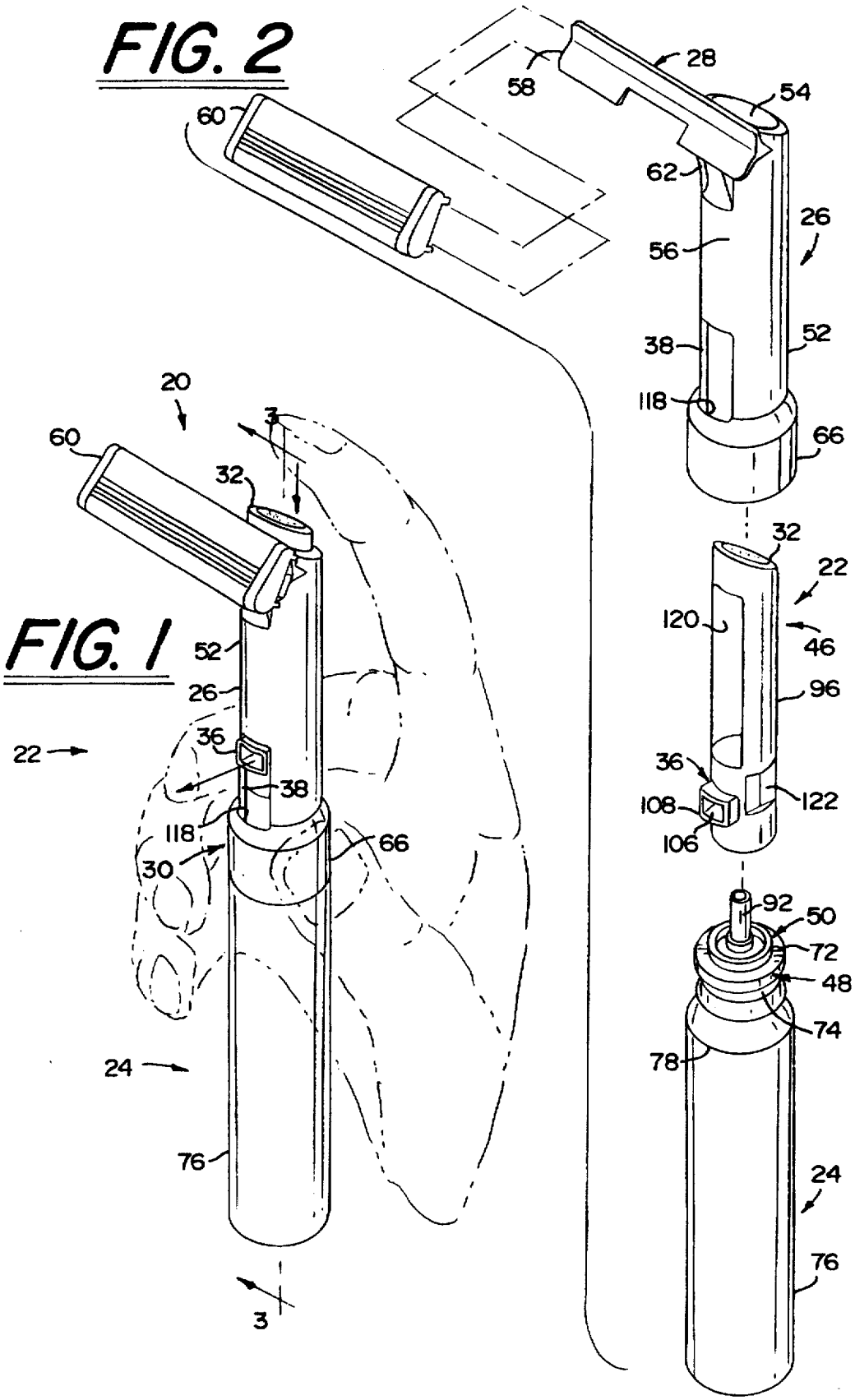
FIG. 1 is a perspective view of a razor system of the present invention including a razor body attached to a canister.
FIG. 2 is an exploded perspective view of the razor system as shown in FIG. 1 in which the razor body has been exploded to show a plunger assembly retained therein, the canister, and a razor head detached from the razor body.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

With reference to FIG. 1, a razor system 20 of the present invention is shown having a razor body 22 and a canister 24. The razor body 22 includes an elongated tubular portion 26 having a razor support 28 (See FIGS. 2 and 3) at one end and a stabilizing structure 30 on an end of the tubular portion 26 opposite the razor support 28. A plunger grip 32 extends from the upper portion 34 of the tubular portion 26. A dispensing port 36 extends through an elongated slot 38 in the elongated body portion 26.

As further shown in FIG. 1, the razor system 20 is held in a user's hand 40 (shown in phantom line). The user operates the plunger grip 32 by pressing downwardly as indicated by the direction arrow 42. The downward force operates a nozzle assembly (See FIGS. 3 and 4) which is connected to a canister valve (See FIGS. 2–4). Shaving foam is dispensed from the dispensing port 36 as indicated by arrow 44. The construction of the razor system 20 of the present invention prevents axial and angular displacement of the razor body 22 relative to the canister 24. The stability of the attachment of the razor body 22 to the canister 24 provides a secure system which prevents or reduces nicks and cuts on a shaver's face.

As shown in FIG. 2, a plunger assembly 46 is telescopically inserted into the razor body 24. The assembled razor body 24 attaches to a head 48 of the canister 24. A canister valve 50 is disposed on the head 48 of the canister 24. The canister 24 and the canister valve 50 are of a known construction.

Figure 3:
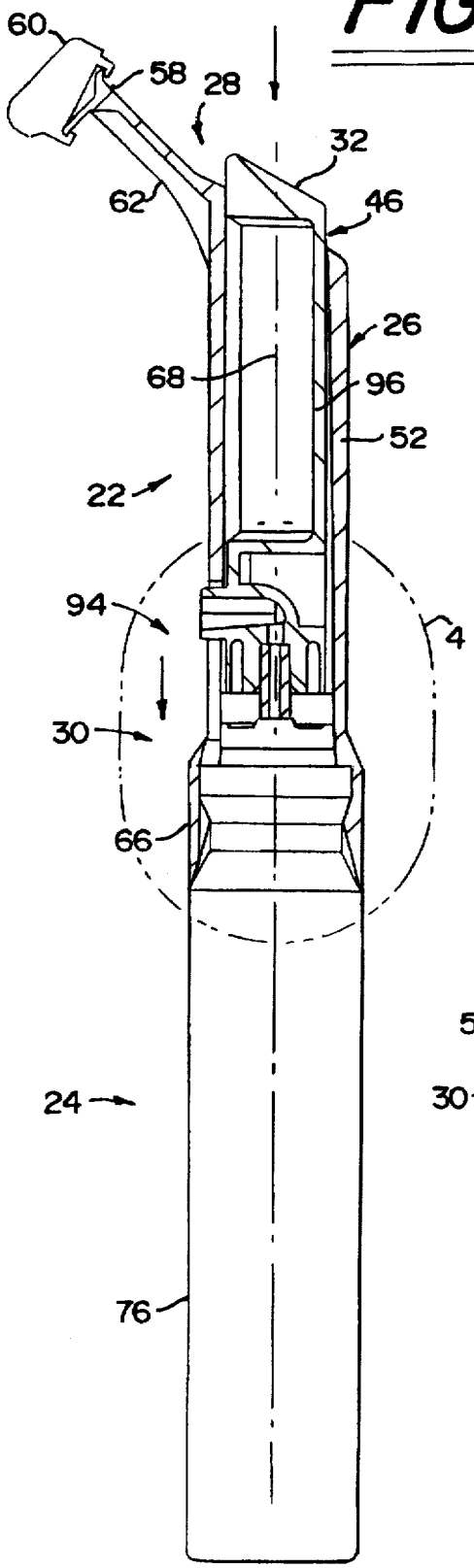
FIG. 3 is a partial fragmentary, cross-sectional, side elevational view taken along line 3—3 in FIG. 1.
Figure 4:
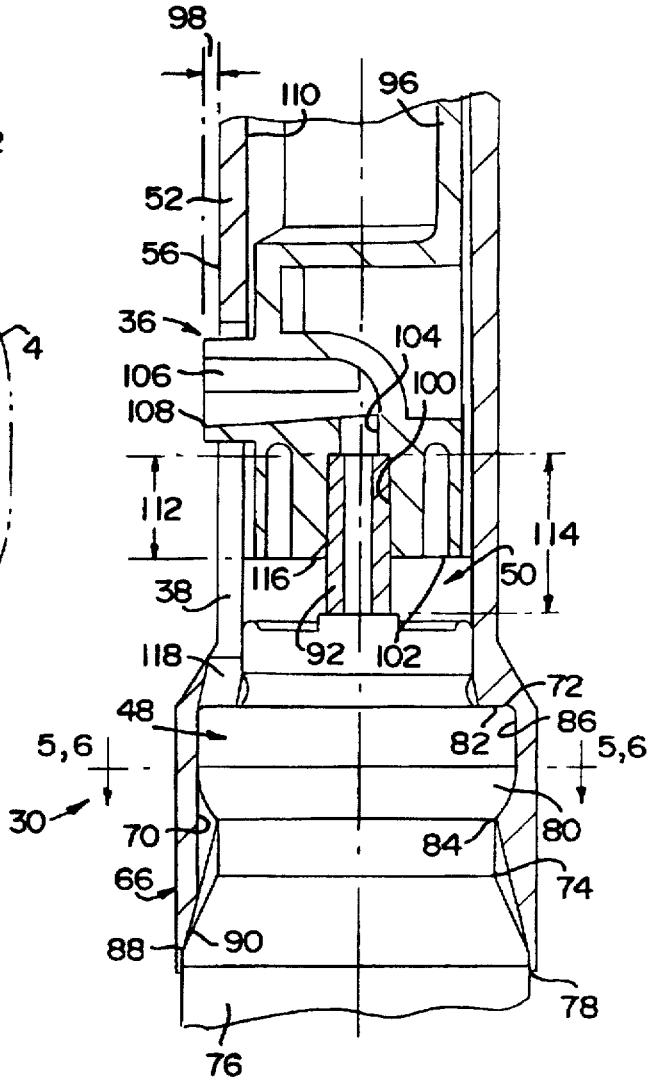
FIG. 4 is an enlarged view of the partial fragmentary, cross-sectional view as indicated in FIG. 3 showing the operation of a nozzle of the plunger assembly engaged with a valve assembly of the canister.

With further reference to FIGS. 3 and 4, the tubular body portion 26 of the razor body 22 includes a wall 52 which define a plunger cavity 54 extending therethrough. The razor support 28 extends away from an outside surface 56 of the wall 52 with a head frame 58 formed on a distal end thereof. A removable, disposal razor head 60 is attached to the head frame 58. It should be noted that a razor head 60 may be permanently attached to the head frame 58 or the head frame 58 may be configured so that the razor head 60 is removable. A rib 62 is provided underneath the razor support 28 to increase the strength and rigidity of the support 28.

The stabilizing structure 30 is attached to the tubular body portion 26 distal the razor support 28. The stabilizing structure 30 includes a sleeve 66 which extends over the head 48 of the canister 24. The stabilizing structure 30 prevents the razor body 22 from being angularly deflected relative to a central axis 68 as well as preventing upward and downward displacement of the body 22 relative to the canister 24. Several structures are formed on an inside surface 70 of the sleeve to engage the head 48. The canister 24 includes a rim 72 formed on the top of the head 48 and a neck 74 formed between the head 48 and a body 76 of the canister 24. A shoulder 78 is formed between the neck 74 and the body 76. An underside surface 80 is formed between the neck and the head 48 and is employed as will be described hereinbelow.

Figure 5:
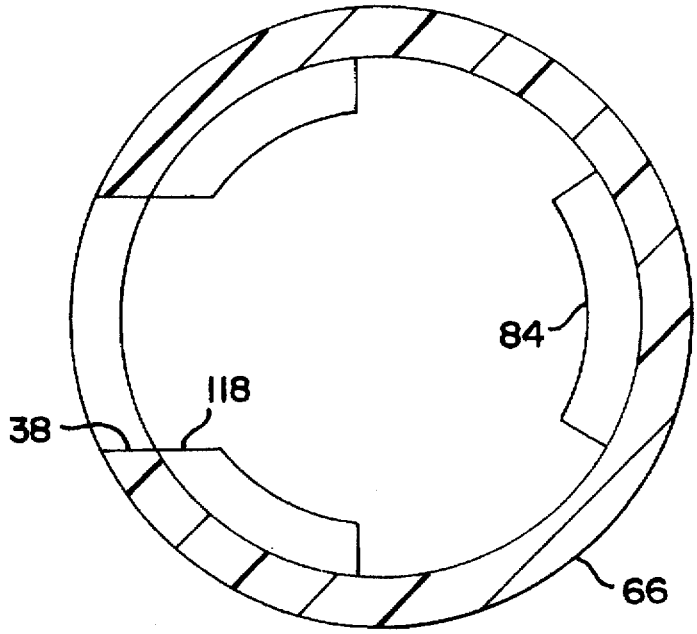
FIGS. 5 and 6 are partial fragmentary, cross-sectional views taken along line 5,6,—5,6, in FIG.4 and in which the canister has been removed to clearly show the structures therein.
Figure 6:
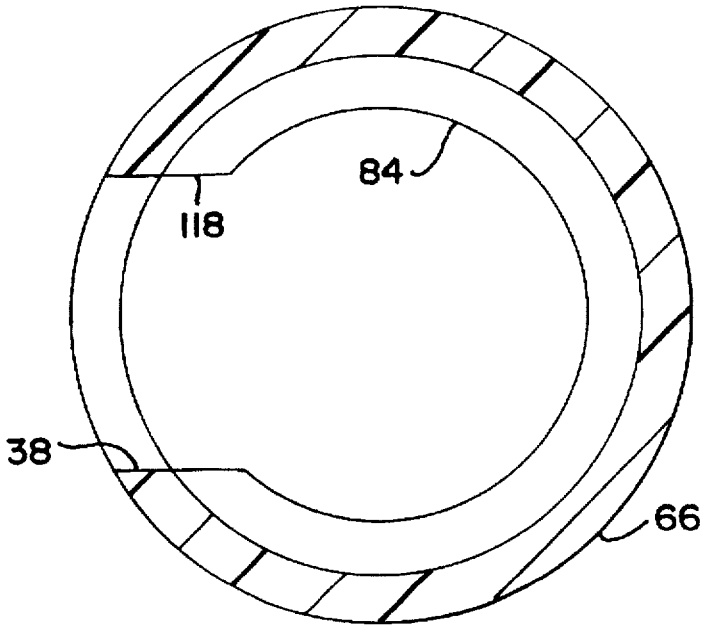

The stabilizing structure 30 includes a ledge 82 which is sized and dimensioned for abutting the rim 72 of the head 48. A plurality of gripping projections 84 are formed on the inside surface spaced away from the ledge 82 multiple generally independent projections as shown in FIG.5 or two spaced apart projecting ends which form a generally annular protrusion. An annular recess 86 is defined between the gripping projections 84 and the ledge 82. The annular recess 86 is sized and dimensioned for cooperatively engaging the outside surface of the head 48.

When the razor body 22 is attached over the head 48, the gripping projections 84 flex slightly outwardly to allow the head 48 to pass therebetween. Once the head 48 is positioned in the annular recess 86 with the rim 72 intimately abutting the ledge 82, the gripping projections 84 tightly engage the underside surface 80. The tight fit of the gripping projections 84 into the neck 74 and against the underside surface 80 forces the ledge 82 into tight engagement against the rim 72. Cooperative engagement of the head 48 in the annular recess 86 by the ledge 82 and the gripping projections 84 prevent upward and downward movement of the razor body 22 relative to the canister 24.

The stabilizing structure 30 also prevents axial displacement of the razor body 22 relative to the central axis 68. The ledge 82 abutting the rim 72, and the gripping projections 84 engaging the neck 74 and against the underside surface 80, retain the razor body 22 against angular deflection. As noted above, the sleeve 66 extends downwardly beyond the neck 74 along the shoulder 78 with an annular lip 88 extending downwardly over the body 76. The structure of the inside surface 90 of the sleeve 66 proximate to the shoulder 78 and along the annular lip 88 provides intimate engagement of the sleeve 66 with the body 76 of the canister 24. The annular lip 88 is a continuous extension of the sleeve 66 which is sized and dimensioned to be tightly fitted over the shoulder 78 and the body 76. The lip 88 prevents angular displacement of the razor body 22 relative to the central axis 68 because it essentially eliminates any play or wobble between the sleeve 66 and the canister 24.

Extending from the head 48 is the canister valve 50. The valve 50 includes a valve stem or dispensing tube 92 extending upwardly therefrom and which engages a nozzle assembly 94. The nozzle assembly 94 is disposed on the plunger assembly 46 on an end thereof distal the plunger grip 32.

With further reference to FIGS. 2–4, the plunger assembly 94 includes a shaft 96 with the plunger grip 32 disposed on an upper end thereof and the nozzle assembly 94 disposed on a lower end thereof. The shaft 96, plunger grip 32 and nozzle assembly 94 are preferably integrally formed as a single piece unitary body. As can be seen more clearly seen in FIG. 3, the plunger assembly 46 telescopically travels along the central axis 68 through the cavity 54. The outside dimensions of the plunger shaft 96 are only slightly smaller than the inside dimensions of the plunger cavity 54. These dimensions help promote controlled axial movement of the plunger assembly 46 in the cavity 54.

The nozzle assembly 94 is integrally formed on the plunger assembly 46 having the dispensing port 36 extending a dimension 98 away from the outside surface 56 when the plunger assembly 46 is positioned in the tubular body 26. The nozzle assembly 94 includes a bore 100 formed in the base 102 of the nozzle assembly 94 for receiving the valve stem 92 therein. A passage 104 connects the valve stem 92 with a throat 106 of the dispensing port 36. It can be seen that a mouth 108 of the dispensing port 36 is positioned away from the outside surface 56 as the dispensing port 36 extends through the elongated slot 38. This is important to prevent the buildup of dried shaving cream which might otherwise accumulate between an inside surface 110 of the cavity 54 and the mouth 108. In prior art devices, a buildup may prevent actuation of the valve.

It should be noted, that a depth dimension 112 of the bore 100 is equal to or greater than one-half of the overall length 114 of the valve stem 92. These dimensions promote secure attachment of the valve stem 92 in the bore 100. Further, a mouth of the bore 100 has a tapered edge 116. This tapered edge 116 helps facilitating alignment and engagement of the valve stem 92 in the bore 100.

An assembly notch 118 is formed on the inside surface 110 of the cavity 54 in an area between the sleeve 66 and the wall 52. The notch 118 communicates with the elongated slot 38 to facilitate engagement of the dispensing port 36 in the elongated slot 38. During assembly, the plunger assembly 46 is axially inserted into the cavity 54 with the dispensing port 36 moving through the assembly notch 118 and into the elongated slot 38. Once the razor body 22 is attached to the canister 24, the plunger assembly 46 cannot become dislodged from the tubular body 26. Upward movement is limited by the dispensing port 36 abutting an upper edge of the elongated slot 38. Downward movement of the plunger 46 is limited by the travel of the valve stem 92 of the valve 50. The plunger assembly 46 may bottom out when the base 102 abuts an upper surface of the valve 50.

An important feature of the present invention is that the razor body 22 is comprised of two pieces, the body portion 26 and the plunger portion 46 which are each integrally formed as single piece unitary bodies. The plunger assembly 46 includes an integrally formed nozzle assembly 94. This simplified construction helps minimizes the number of parts necessary to provide the razor body 22. The reduced number of parts simplifies the assembly and minimizes the amount of labor required to assemble the razor body 22. Further, the simplified construction reduces the number of parts and therefore reduces the number and complexity of the molds necessary to injection mold these components. The components are preferably injection molded from a polypropylene material which provides a degree of resiliency for assembling the stabilizing structure 30 on the canister 24 while minimizing the material costs and injection molding complexities.

With regard to the molding of the structures, a plunger relief 120 is formed in the shaft 96 to minimize the material and maintain a generally uniform wall thickness. The relief 120 does not reduce the structural integrity or strength of the shaft 96. Side reliefs 122 are provided in the area of the plunger 46 in which the nozzle assembly 94 is formed. These side reliefs 122 maintain the structural integrity and wall uniformity in the nozzle assembly 94 thereby maintaining desired dimensional tolerances. It is important to maintain the dimensional tolerances of the nozzle assembly 94 so as to provide an intimate engagement between the bore 100 and the valve stem 92.

While a preferred embodiment of the present invention is shown and described, it is envisioned that those skilled in the art may devise various modifications and equivalents without departing from the spirit and scope of the appended claims. The invention is not intended to be limited by the foregoing disclosure.

The invention claimed is:

1. A razor body for use with a canister containing aerosol shaving cream, said canister including a body portion, a head portion disposed thereon, a neck positioned between said head and said body and a canister valve assembly disposed on said head for dispensing shaving cream from said canister, said razor body comprising:

an axially elongated, hollow tubular body portion having a wall defining a tubular cavity extending therethrough;

an elongated slot in said wall of said hollow tubular body;

an axially elongated plunger assembly positioned in said cavity having a plunger shaft, a nozzle assembly engageable with said canister valve assembly, a dispensing portion of said nozzle assembly extending from said elongated plunger shaft through said elongated slot, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

a razor support attached to said tubular body portion at a position distal said canister;

a stabilizing structure attached to said tubular body portion for engaging and retaining said razor body on said head and said body of said canister, said stabilizing structure including at least one protrusion on an inside surface of said tubular body portion, said stabilizing structure preventing axially and angular displacement at said razor body relative to said central axis; and an assembly notch on an inside surface of said sleeve of said stabilizing structure, said notch extending generally parallel to an axis of elongation of said sleeve and communicating with said elongated slot allowing said dispensing portion of said nozzle assembly to pass therethrough for extension through said slot when assembling said plunger with said tubular body portion.

2. A razor body as recited in claim 1, said head of said canister including a rim along a top surface of said head and said neck of said canister defining an underside surface of said head, said stabilizing structure further comprising:

a tubular sleeve extending from said tubular body portion;

a ledge formed on an inside surface of said sleeve sized and dimensioned for abutting said rim of said head; and at least one projection extending from said inside surface of said sleeve spaced from said ledge for engaging said underside surface of said head.

3. A razor body for use with a canister containing aerosol shaving cream, said canister including a body portion, a head portion disposed thereon, a neck positioned between said head and said body and a canister valve assembly disposed on said head for dispensing shaving cream from said canister, said head of said canister including a rim along a top surface of said head and said neck of said canister defining an underside surface of said head, said razor body comprising:

an axially elongated, hollow tubular body portion having a wall defining a tubular cavity extending therethrough;

an axially elongated plunger assembly positioned in said cavity having a plunger shaft, a nozzle assembly engageable with said canister valve assembly, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

a razor support attached to said tubular body portion at a position distal said canister; and a stabilizing structure attached to said tubular body portion for engaging and retaining said razor body on said head and said body of said canister, said stabilizing structure preventing axially and angular displacement of said razor body relative to said central axis, said stabilizing structure including a tubular sleeve extending from said tubular body portion said sleeve extending a length to abut said body portion of said canister to prevent angular displacement, a ledge formed on an inside surface of said sleeve sized and dimensioned for abutting said rim of said head, and multiple, spaced apart projections extending from said inside surface of said sleeve spaced from said ledge for engaging said underside surface of said head, said multiple projections promoting engagement of said razor body on said canister.

4. A razor body for use with a canister containing aerosol shaving cream, said canister including a body portion, a head portion disposed thereon, a neck positioned between said head and said body and a canister valve assembly disposed on said head for dispensing shaving cream from said canister, said head of said canister including a rim along a top surface of said head and said neck of said canister defining an underside surface of said head, said razor body comprising:

an axially elongated, hollow tubular body portion having a wall defining a tubular cavity extending therethrough;

an axially elongated plunger assembly positioned in said cavity having a plunger shaft, a nozzle assembly engageable with said canister valve assembly, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

a razor support attached to said tubular body portion at a position distal said canister;

a stabilizing structure attached to said tubular body portion for engaging and retaining said razor body on said head and said body of said canister, said stabilizing structure preventing axially and angular displacement of said razor body relative to said central axis, further including a tubular sleeve extending from said tubular body portion said sleeve extending a length to abut said body portion of said canister to prevent angular displacement, a ledge formed on an inside surface of said sleeve sized and dimensioned for abutting said rim of said head, and multiple, spaced apart projections formed on said inside surface of said sleeve for engaging said underside surface of said head, said multiple projections promoting initial engagement of said razor body on said canister; and said ledge and said multiple projections defining an annular recess therebetween, said annular recess being sized and dimensioned for engaging said head, said multiple projections being spaced from said ledge for forcing said ledge into close abutting engagement with said rim of said head.

5. A razor body for use with a canister containing aerosol shaving cream, said canister including a body portion, a head portion disposed thereon, a neck positioned between said head and said body and a canister valve assembly disposed on said head for dispensing shaving cream from said canister, said razor body comprising:

an axially elongated, hollow tubular body portion having a wall defining a tubular cavity extending therethrough:

an axially elongated plunger assembly positioned in said cavity having a plunger shaft, a nozzle assembly engageable with said canister valve assembly, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

said head of said canister including a rim along a top surface of said head and said neck of said canister defining an underside surface of said head;

a tubular sleeve extending from said tubular body portion;

a ledge formed on an inside surface of said sleeve sized and dimensioned for abutting said rim of said head;

at least one projection extending from said inside surface of said sleeve spaced from said ledge for engaging said underside surface of said head;

a razor support attached to said tubular body portion at a position distal said canister, and a stabilizing structure attached to said tubular body portion for engaging and retaining said razor body on said head and said body of said canister, said stabilizing structure including at least one annular protrusion on an inside surface of said tubular body portion having two spaced apart ends, said stabilizing structure preventing axially and angular displacement of said razor body relative to said central axis;

said stabilizing structure further comprising an annular lip extending from said sleeve, said annular lip being sized and dimensioned for extending over said shoulder of said canister and downwardly along a portion of said body of said canister to prevent angular deflection of said razor body relative to said central axis when said razor body is attached to said canister.

6. A razor body for use with a canister containing aerosol shaving cream, said canister including a body portion, a head portion disposed thereon, a neck positioned between said head and said body and a canister valve assembly disposed on said head for dispensing shaving cream from said canister, said head of said canister including a rim along a top surface of said head and said neck of said canister defining an underside surface of said head, said razor body comprising:

an axially elongated, hollow tubular body portion having a wall defining a tubular cavity extending therethrough;

an axially elongated plunger assembly positioned in said cavity having a plunger shaft, a nozzle assembly engageable with said canister valve assembly, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

a razor support attached to said tubular body portion at a position distal said canister; and a stabilizing structure attached to said tubular body portion for engaging and retaining said razor body on said head and said body of said canister, said stabilizing structure preventing axially and angular displacement of said razor body relative to said central axis, said stabilizing structure including a tubular sleeve extending from said tubular body portion, a ledge formed on an inside surface of said sleeve sized and dimensioned for abutting said rim of said head, and projecting means formed on said inside surface of said sleeve spaced from said ledge for engaging said underside surface of said head, said projecting means promoting initial engagement of said razor body on said canister; said ledge and said projecting means defining an annular recess therebetween, said annular recess being sized and dimensioned for intimately engaging said head, said projecting means being spaced from said ledge for forcing said ledge into close abutting engagement with said rim of said head; and an annular lip extending from said sleeve, said annular lip being sized and dimensioned for extending over said shoulder of said canister and downwardly along a portion of said body of said canister to prevent angular deflection of said razor body relative to said central axis when said razor body is attached to said canister.

7. A razor body as recited in claim 1, said plunger further comprising said plunger shaft, plunger grip and said nozzle assembly being integrally formed as a unitary, single piece body.

8. A razor body as recited in claim 1, said razor body further comprising:

an elongated slot in said wall of said tubular body portion, said slot being generally oriented parallel to said central axis of said tubular body portion;

a dispensing port of said nozzle assembly extending from said elongated plunger assembly through said elongated slot;

a mouth of said dispensing port being positioned a distance away from an outside surface of said wall of said tubular body portion; and a base of said nozzle assembly positioned proximate to said canister valve having a bore for receiving a valve stem of said canister valve.

9. A razor body as recited in claim 8, said nozzle assembly further comprising:

said bore in said base of said valve assembly having a depth dimension which is greater than one-half a length dimension of said valve stem extending from said canister valve.

10. A razor body for use with a canister containing aerosol shaving cream, said canister including a body portion, a head portion disposed thereon, a neck positioned between said head and said body and a canister valve assembly disposed on said head for dispensing shaving cream from said canister, said razor body comprising:

an axially elongated, hollow tubular body portion having a wall defining a tubular cavity extending therethrough;

an elongated slot in said wall of said tubular body portion, said slot being generally oriented parallel to said central axis of said tubular body portion;

an axially elongated plunger assembly positioned in said cavity having a plunger shaft, a nozzle assembly engageable with said canister valve assembly, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

a razor support attached to said tubular body portion at a position distal said canister;

a dispensing port of said nozzle assembly extending from said elongated plunger assembly through said elongated slot;

a mouth of said dispensing port being positioned a distance away from an outside surface of said wall of said tubular body portion;

a base of said nozzle assembly positioned proximate to said canister valve having a bore for receiving a valve stem of said canister valve, a mouth of said bore having an inwardly tapered edge for cooperatively receiving said valve stem of said canister valve therein when said razor body is assembled with said canister; and a stabilizing structure attached to said tubular body portion for engaging and retaining said razor body on said head and said body of said canister, said stabilizing structure preventing axially and angular displacement of said razor body relative to said central axis.

11. A razor body in combination with a canister containing aerosol shaving cream, said canister including a body portion, a head portion disposed thereon, a neck positioned between said head and said body and a canister valve assembly disposed on said head for dispensing shaving cream from said canister, said razor body comprising:

an axially elongated, hollow tubular body portion having a wall defining a tubular cavity extending therethrough;

an axially elongated plunger assembly positioned in said cavity having a plunger shaft, a nozzle assembly engageable with said canister valve assembly, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

a razor support attached to said tubular body portion at a position distal said canister; and a stabilizing structure attached to said tubular body portion for engaging and retaining said razor body on said head and said body of said canister, said stabilizing structure preventing axially and angular displacement of said razor body relative to said central axis, said stabilizing structure including at least one, at least partially, annular protrusion on an inside surface of said tubular body.

12. A razor system having a razor body and a canister containing aerosol shaving cream, said canister including a body portion, a head portion disposed thereon, a neck positioned between said head and said body and a canister valve assembly disposed on said head for dispensing shaving cream from said canister, a rim along a top surface of said head and said neck of said canister defining an underside surface of said head, said razor body of said razor system comprising:

an axially elongated, hollow tubular body portion having a wall defining a tubular cavity extending therethrough;

an axially elongated plunger assembly positioned in said cavity having a plunger shaft, a nozzle assembly engageable with said canister valve assembly, a nozzle plunger grip extending from a second end of said plunger shaft distal said assembly formed on one end of said plunger shaft, said plunger being axially displaceable in said cavity for activating said canister valve assembly to dispense shaving cream from said canister through said nozzle assembly;

a central axis defined by said tubular body portion and said plunger assembly;

a razor support attached to said tubular body portion at a position distal said canister; and a stabilizing structure attached to said tubular body portion for engaging and retaining said razor body on said head and said body of said canister, said stabilizing structure preventing axially and angular displacement of said razor body relative to said central axis, said stabilizing structure having a tubular sleeve extending from said tubular body portion, projecting means formed on said inside surface of said sleeve for engaging said underside surface of said head, said projecting means promoting initial engagement of said razor body on said canister, a ledge formed on an inside surface of said sleeve sized and dimensioned for abutting said rim of said head, said ledge and said projecting means defining an annular recess therebetween, said annular recess being sized and dimensioned for intimately engaging said head, said projecting means being spaced from said ledge for forcing said ledge into close abutting engagement with said rim of said head, and an annular lip extending from said sleeve, said annular lip being sized and dimensioned for extending over said shoulder of said canister and downwardly along a portion of said body of said canister to prevent angular deflection of said razor body relative to said central axis when said razor body is attached to said canister.

13. A razor system as recited in claim 12, said razor body further comprising:

an elongated slot in said wall of said tubular body portion, said slot being generally oriented parallel to said central axis of said tubular body portion;

a dispensing port of said nozzle assembly extending from said plunger through said elongated slot;

a mouth of said dispensing port being positioned a distance away from an outside surface of said wall of said tubular body portion; and a base of said nozzle assembly positioned proximate to said canister valve having a bore for receiving a valve stem of said canister valve.

14. A razor body having a hollow tubular body portion and a plunger portion, said tubular body being integrally formed as a unitary single piece structure having a razor support formed on one end and a stabilizing structure formed on an opposite end, said plunger having a shaft with a plunger grip formed on one end and a nozzle assembly formed on an opposite end thereof, said stabilizing structure of said tubular body including a sleeve extending from said tubular body portion, a ledge and at least one gripping protrusion on an inside surface of said sleeve for engaging said stabilizing structure with a head portion of an aerosol canister, an elongated aperture formed in said tubular body portion proximate to said stabilizing structure for receiving a dispensing port of said nozzle assembly therethrough, an assembly notch on an inside surface of said sleeve of said stabilizing structure, said notch extending generally parallel to an axis of elongation of said sleeve and communicating with said elongated slot allowing said dispensing port of said nozzle assembly to pass therethrough when assembling said plunger with said tubular body portion.

15. A razor body as recited in claim 14, said head of said canister including a rim along a top surface of said head and said neck of said canister defining an underside surface of said head, said stabilizing structure further comprising:

a tubular sleeve extending from said tubular body portion;

a ledge formed on an inside surface of said sleeve sized and dimensioned for abutting said rim of said head;

multiple spaced apart projections formed on said inside surface of said sleeve for engaging said underside surface of said head, said multiple projections promoting initial engagement of said razor body on said canister; and said ledge and said multiple projections defining an annular recess therebetween, said annular recess being sized and dimensioned for engaging said head, said multiple projections being spaced from said ledge for forcing said ledge into close abutting engagement with said rim of said head.

16. A razor body having a hollow tubular body portion and a plunger portion, said tubular body being integrally formed as a unitary single piece structure having a razor support formed on one end and a stabilizing structure formed on an opposite end, said plunger having a shaft with a plunger grip formed on one end and a nozzle assembly formed on an opposite end thereof, said stabilizing structure of said tubular body including a sleeve extending from said tubular body portion, a ledge and at least one gripping projection formed on an inside surface of said sleeve for engaging said stabilizing structure with a head portion of an aerosol canister, an elongated aperture formed in said tubular body portion proximate to said stabilizing structure for receiving a dispensing port of said nozzle assembly therethrough;

an elongated slot in said wall of said tubular body portion, said slot being generally oriented parallel to said central axis of said tubular body portion;

a dispensing port of said nozzle assembly extending from said plunger through said elongated slot;

a mouth of said dispensing port being positioned a distance away from an outside surface of said wall of said tubular body portion; and a base of said nozzle assembly positioned proximate to said canister valve having a bore for receiving a valve stem of said canister valve.

17. A razor body as recited in claim 16, said nozzle assembly further comprising:

said bore in said base of said valve assembly having a depth dimension which is greater than one-half a length dimension of said valve stem extending from said canister valve.

* * * * *